United States Patent [19]

Fidi

[11] 4,447,678

[45] May 8, 1984

[54] ELECTRACOUSTIC TRANSDUCER

[75] Inventor: Werner Fidi, Baden, Austria

[73] Assignee: AKG Akustische u.Kino-geräte gesellschaft mbH, Austria

[21] Appl. No.: 286,175

[22] Filed: Jul. 23, 1981

[30] Foreign Application Priority Data

Jul. 28, 1980 [AT] Austria ..... 3920/80

[51] Int. Cl.[3] ..... H04R 1/28; H04R 1/24

[52] U.S. Cl. ..... 179/115.5 PS; 179/111 R; 179/111 E; 179/116; 181/153; 181/158; 181/190

[58] Field of Search ..... 181/163, 150, 153, 158, 181/190; 179/116, 111 E, 111 R, 179, 183, 115.5 PS

[56] References Cited

U.S. PATENT DOCUMENTS

| | | | |
|---|---|---|---|
| 3,436,492 | 4/1969 | Reedyk | 179/111 R |
| 3,943,304 | 3/1976 | Piribauer | 179/111 E |
| 4,014,091 | 3/1977 | Kodera et al. | 307/400 X |

FOREIGN PATENT DOCUMENTS 323823 7/1975 Austria .

*Primary Examiner*—A. D. Pellinen
*Assistant Examiner*—Danita R. Byrd
*Attorney, Agent, or Firm*—McGlew and Tuttle

[57] ABSTRACT

An electroacoustic two-way transducer assembly particularly for headphones and microphones comprises an electrostatic treble system having an electrostatic treble system disphragm and an electrodynamic system disposed under said electrostatic treble system. The electrodynamic system has an attachment portion with a flat front side forming a disc-shaped back plate for the electrostatic treble system diaphragm.

15 Claims, 1 Drawing Figure

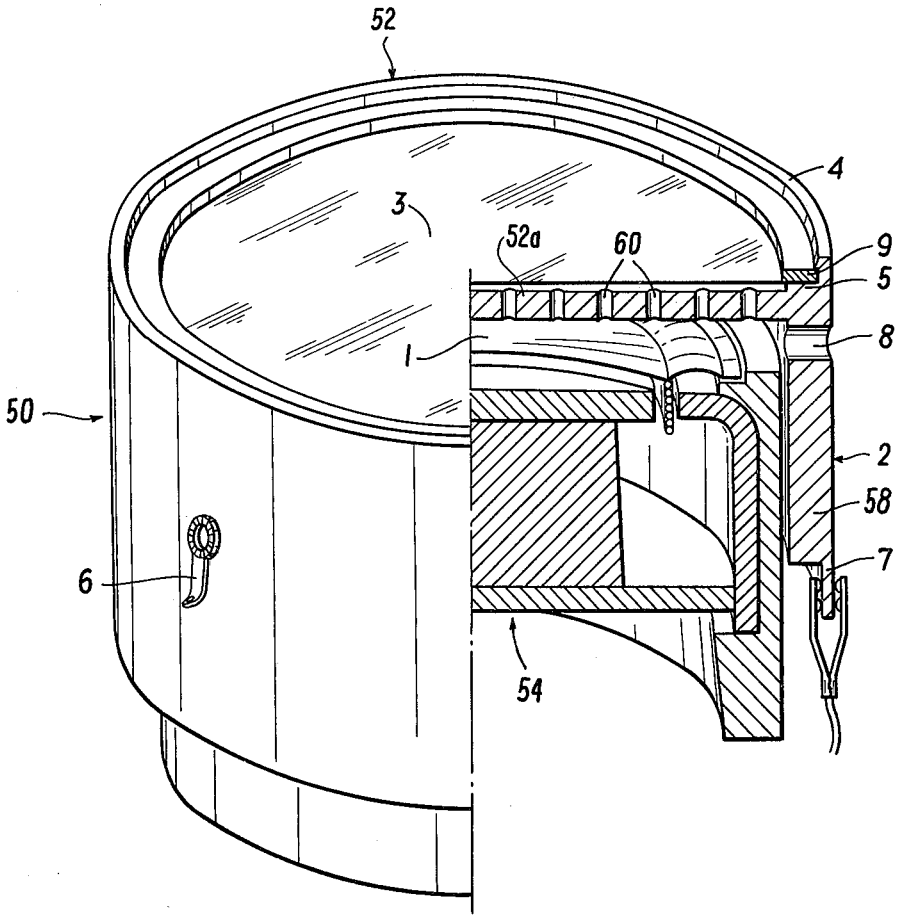
52
4
3
52a
60
9
5
8
1
50
2
58
7
6
54

ELECTRACOUSTIC TRANSDUCER

FIELD AND BACKGROUND OF THE INVENTION

This invention relates in general to the construction of transducers and in particular to a new and useful electroacoustic two-way transducer assembly particularly for headphones and microphones which comprises an electrostatic treble system and an electrodynamic system.

A transducer assembly is disclosed in Austrian Pat. No. 323 823, for example. It comprises two transducer capsules, namely an electrostatic high-frequency system and an electrodynamic low-frequency system, which are disposed close to each other. Such an arrangement however, requires a construction which is relatively expensive so that the manufacturing costs considerably exceed the average level.

SUMMARY OF THE INVENTION

The invention is directed to a substantial simplification of the construction of two-way transducer assemblies which include an electrostatic and an electrodynamic transducer. The inventive solution starts from the assumption that the electrodynamic transducer is equipped with an attachment which is placed in front of the diaphragm thereof and intended to protect the transducer diaphragm against dust and mechanical damages; and may, in addition, be employed to form a resonator, of the air volume enclosed between the attachment and the transducer diaphragm, which may communicate with the ambient air through lateral apertures, to obtain the desired frequency response.

In accordance with the invention, the attachment is designed to form a disc-shaped back plate for a diaphragm of the electrostatic high-frequency system.

Due to this design, an advantageous coaxial arrangement of the two transducers is obtained, since in practice, two individual transducers are only fitted into one another. Special supporting structures for the individual transducers can thus be omitted so that a desired space-saving construction is obtained. To simplify and facilitate the assembly, it is further provided that the marginal zone of the attachment is designed to receive a ring for retaining the diaphragm. With this design, what is to be done is only to place the diaphragm fitted with a retaining ring onto the attachment and, for example, engage it by slight pressure under hook-shaped projections provided on the outer circumference of the marginal zone. However, the diaphragm may also be fixed directly to the attachment, if a step is provided in the marginal zone thereof, determining the spacing between the diaphragm and the back plate.

The attachment may be a metallic part, however, it is better and advantageous to make it of a non-metallic but electrically conducting material. It is of particular advantage if the attachment is injection molded of an electrically conducting plastic. To operate the electrostatic transducer electrical connections are needed. They may take the shape of lug elements provided on the attachment, or the attachment may be formed with suitable projections to which, preferably, spring clips may be clamped.

Accordingly, it is an object of the invention to provide an electroacoustic two-way transducer assembly which comprises an electrostatic treble system having an electrostatic treble system diaphragm and an electrodynamic system disposed under said electrostatic treble system and having an attachment with a flat front side forming a disc-shaped backplate for the electrostatic treble system diaphragm.

A further object of the invention is to provide an electroacoustic transducer assembly which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a partial front end perspective and partial sectional view of a electrostatic transducer constructed in accordance with the invention.

DESCRIPTION OF THE PREFERRED EMBODIMENT

Referring to the drawing, in particular the invention embodied therein comprises an electroacoustic two-way transducer assembly generally designated 50 which is particularly for headphones and microphones and which comprises an electrostatic treble system generally designated 52 arranged over an electrodynamic system generally designated 54. The electrostatic system includes an attachment generally designated 2 which in the embodiment illustrated is a generally cylindrical part which in accordance with the invention has a disc-shaped back plate portion **52*a* which forms a back plate for a diaphragm 3 of the electrostatic system which is a high frequency system. The attachment generally designated 2 also includes a side wall portion or wall 58 having a plurality of apertures 8 therein. The wall 52*a* forming the back plate portion for the diaphragm 3 of the electrostatic high frequency system is also provided with a plurality of openings 60. The openings 60 and 8 permit a passage of sound or prevent the air cushion enclosed between the diaphragm 3 and the back plate 52*a* of the electrostatic transducer from causing undesirable resonances. The lateral apertures 8 establish communication between the air volume enclosed by a diaphragm 1 of the low frequency electrodynamic system 54 and the disc-shaped back plate portion 52*a*** and the outside air in order to influence the frequency response.

In conventional dynamic transducers, a suitable attachment such as the attachment 2 is almost always provided in front of the diaphragm, to protect the diaphragm 1 from dust and mechanical damages and, in addition, to obtain the desired frequency response by forming a resonator, including the air volume within the attachment and suitable apertures 8 in the side wall 58.

In accordance with the invention, the outer front surface of the attachment 2 is employed as the back plate **52*a* for the electrostatic transducer 52. For this purpose, the attachment must either be a metallic part, or must be made electrically conducting, for example, provided with a metal coating deposited by evaporation or by electroplating. Attachment 2** may also be made of an electrically conducting plastic, by injection molding, for example.

To provide the necessary spacing between the diaphragm and the outer surface of the back plate portion of the attachment, an additional spacer ring may be inserted. It is also possible however, to design the attachment 2 with an outer rim 5 which is raised relative to the central back plate portion 52*a* by the desired spacing of the diaphragm 3 from the back plate portion, and used as a mounting surface for the diaphragm.

The back plate 52*a* may be electrically connected either through an additional lug element 6 which, for example, may be riveted to the electrically conducting attachment 2, or through an element 7 integrally formed as a depending projection on the attachment. Other connections or both of the mentioned connections, may also be provided of course.

The diaphragm 3 may be secured by an adhesive directly to outer rim 5 or to a spacer ring (not shown). It is also possible of course first to fix the diaphragm in a clamping ring 9 and then to secure this ring to the inventive attachment under a projecting ridge 4 of the attachment 2.

It is advantageous to design the electrostatic treble system as an electret system, both with an electret diaphragm and in the "back-electret" technique, i.e. with an electret-coated back plate.

While a specific embodiment of the invention has been shown and described in detail to illustrate the application of the principles of the invention, it will be understood that the invention may be embodied otherwise without departing from such principles.

What is claimed is:

1. An electroacoustic two-way transducer, particularly for headphones and microphones, comprising:

an electrodynamic low-frequency system having a front face and a diaphragm extending over at least a major portion of said front face;

an electrostatic treble system having a diaphragm;

a cylindrical casing for accommodating both electrodynamic and said electrostatic systems, said systems being positioned with respect to said cylindrical casing in a coaxial relative position to each other;

said electrostatic treble system including a sound transmitting disc-shaped cover plate adjacent said diaphragm of said electrodynamic system and extending over the entire front face of said electrodynamic system.

2. An electroacoustic two-way transducer assembly, according to claim 1, wherein said cylindrical casing includes an upper raised rim having an inwardly extending top portion, and a diaphragm retaining ring disposed over said rim, said electrostatic treble system diaphragm engaged between said rim and said ring.

3. An electroacoustic two-way transducer assembly according to claim 2, wherein said cylindrical casing comprises an electrically conducting material.

4. An electroacoustic two-way transducer according to claim 2 wherein said cylindrical casing comprises an injection molded part of an electrically conducting plastic.

5. An electroacoustic two-way transducer assembly according to claim 2 including an electrical connection disposed on said cylindrical casing comprising a lug element.

6. An electroacoustic two-way transducer assembly according to claim 2, comprising a projection formed on said cylindrical casing on a side wall thereof forming an electrical connection.

7. An electroacoustic two-way transducer assembly according to claim 2, wherein said electrostatic treble system comprises an electret system having an electret diaphragm comprising said electrostatic treble system diaphragm and a back plate coated with an electret material.

8. An electroacoustic two-way transducer, particularly for headphones and microphones, comprising:

an electrodynamic low-frequency system having a front face and a diaphragm extending over at least a major portion of said front face;

an electrostatic treble system having a sound transmitting disc-shaped cover plate and a diaphragm extending over a major portion of said cover plate;

a cylindrical outer wall portion connected to said cover plate, said cover plate closing an upper end of said cylindrical wall portion;

said electrodynamic system enclosed by said cylindrical wall portion and positioned coaxially with respect to said electrostatic treble system, said cover plate being disposed adjacent said diaphragm of said electrodynamic system and extending over the entire front face of said electrodynamic system.

9. An electroacoustic two-way transducer assembly according to claim 8, wherein said cylindrical wall portion comprises an electrically conducting material.

10. An electroacoustic two-way transducer according to claim 8, wherein said cylindrical wall portion comprises an injection molded part of an electrically conducting plastic.

11. An electroacoustic two-way transducer assembly according to claim 8, including an electrical connection disposed on said cylindrical wall portion comprising a lug element.

12. An electroacoustic two-way transducer assembly according to claim 8, comprising a projection formed on said cylindrical wall portion forming an electrical connection.

13. An electroacoustic two-way transducer assembly according to claim 8, wherein said electrostatic treble system comprises an electret system having an electret diaphragm comprising said electrostatic treble system diaphragm and a back plate coated with an electret material.

14. An electroacoustic two-way transducer according to claim 8 wherein said cylindrical wall portion includes an inwardly extending step forming a rim around said disc-shaped cover plate which has a surface disposed upwardly of the surface of said cover plate, said electrostatic system diaphragm being disposed on said rim based upwardly of said cover plate.

15. An electroacoustic two-way transducer assembly consisting essentially of:

a cylindrical outer wall portion having a top end and an open bottom end;

a flat disc shaped back plate extending across the top end of said cylindrical outer wall portion having a plurality of spaced apertures therethrough, said cylindrical outer wall portion and said back plate made of electrically conducting material;

an electrodynamic system disposed in said cylindrical outer wall portion below said back plate and having an electrodynamic diaphragm spaced below said back plate;

said cylindrical outer wall portion including a plurality of apertures therethrough communicating with the space between said back plate and said electrodynamic diaphragm;

said cylindrical outer wall portion including a rim extending upwardly of said back plate and including an inwardly extending step disposed upwardly of said back plate;

an electrostatic treble system diaphragm extending over said back plate at a spaced location with said back plate and resting on said inwardly extending step; and a retaining ring engaged on said step and over said electrostatic treble system diaphragm for retaining said treble system diaphragm on said step;

said electrostatic treble system diaphragm and spaced back plate with apertures therethrough forming an electrostatic treble system above said electrodynamic system.

* * * * *